US011231206B2

(12) United States Patent
Butt et al.

(10) Patent No.: US 11,231,206 B2
(45) Date of Patent: Jan. 25, 2022

(54) COUNTER BALANCED LID

(71) Applicant: The Marley-Wylain Company, Michigan City, IN (US)

(72) Inventors: Neil Butt, New Carlisle, IN (US); Joel Bodine, Valparaiso, IN (US); Michael Hostetler, Valparaiso, IN (US); Frederick Hoffmaster, LaPorte, IN (US)

(73) Assignee: The Marley Company LLC, Burr Ridge, IL (US)

( * ) Notice: Subject to any disclaimer, the term of this patent is extended or adjusted under 35 U.S.C. 154(b) by 0 days.

(21) Appl. No.: 16/733,865

(22) Filed: Jan. 3, 2020

(65) Prior Publication Data

US 2021/0207849 A1 Jul. 8, 2021

(51) Int. Cl.

| | |
|---|---|
| ***F24H 9/02*** | (2006.01) |
| ***F24H 9/18*** | (2006.01) |
| ***F24H 9/00*** | (2006.01) |
| *F24H 1/14* | (2006.01) |

(52) U.S. Cl.

CPC ..... *F24H 9/02* (2013.01); *F24H 9/0026* (2013.01); *F24H 9/1836* (2013.01); *F24H 1/145* (2013.01)

(58) Field of Classification Search

CPC . F24H 9/18; F24H 9/02; F24H 9/1836; F24H 9/0026; F22B 5/04; F22B 9/04; F22B 9/00; F22B 5/00; F23D 14/30; F23D 5/045; F28D 21/0007; F28D 2021/0024; F28D 21/0003; F28D 21/0014; F24D 2200/18; F24D 3/08; F24D 19/1006; F24D 17/00; F24D 19/0097; F24D 19/06; F24D 2200/046; F24D 3/122; F28F 3/04; F28F 13/12; F28F 9/001; F28F 25/12; F28F 3/048

USPC ..... 122/19.2

See application file for complete search history.

(56) References Cited

U.S. PATENT DOCUMENTS

| | | | | |
|---|---|---|---|---|
| 4,329,943 | A * | 5/1982 | Schworer | F24H 9/1836 122/13.01 |
| 5,687,678 | A * | 11/1997 | Suchomel | F24H 8/00 122/250 R |
| 2009/0165733 | A1* | 7/2009 | Ferguson | F23D 14/02 122/18.3 |
| 2013/0017775 | A1* | 1/2013 | Chwala | F24F 13/32 454/354 |
| 2015/0285560 | A1* | 10/2015 | Silversand | F28D 9/0012 165/166 |

* cited by examiner

*Primary Examiner* — Edelmira Bosques
*Assistant Examiner* — Andrew W Cheung
(74) *Attorney, Agent, or Firm* — BakerHostetler

(57) ABSTRACT

A lid for a heat generating device in which the heat generating device has a body with a combustion chamber disposed therein. The lid includes an air moving device, an air intake housing, and a hinge. The air moving device is configured to generate a flow of air. The air intake housing is disposed between the lid and the air moving device. The air intake housing extends out from the lid to cantilever the air moving device out from the lid. The hinge is disposed between the lid and the body and proximal to the air intake housing. The hinge is configured to provide a pivot for the lid. A weight of the air moving device counter balances at least a portion of a weight of the lid to ease pivoting of the lid into an open position.

14 Claims, 8 Drawing Sheets

COUNTER BALANCED LID

FIELD OF THE INVENTION

This invention relates generally to a device for generating heat. More particularly, the present invention relates, for example, to an improved lid for use with a suitable heat generating device.

BACKGROUND OF THE INVENTION

Generally, boilers and other heat generating devices generate heat and typically transfer that heat to a transfer fluid such as water, steam, air, etc. Some of these boilers burn a combustible fuel to generate the heat and then transfer the heat in the combustion gasses to the transfer fluid via a heat transfer unit or heat exchanger having a parallel or counterflow of hot combustion gasses and transfer fluid so that the transfer fluid absorbs the heat from the combustion gasses. Traditionally, combustion occurs at a lower portion of a boiler, the heat transfer unit is located above the combustion chamber, and the flue to vent the exhaust gasses is located above the heat exchange.

While this conventional boiler design worked well when sufficient heat remained in the exhaust gasses to draw the combustion gasses through the boiler and out the flue, newer condensing boilers extract too much heat from the combustion gasses for the boiler to function. Blowers are used to force ventilate condensing boilers. However, the increased complexity of boilers makes them difficult to maintain and service. Accordingly, there is a need in the art to improve the boiler.

SUMMARY OF THE INVENTION

The foregoing needs are met, to a great extent, by the present invention, wherein aspects of a counter balanced lid for a boiler are provided.

An embodiment of the present invention pertains to a lid for a heat generating device. The heat generating device has a body with a combustion chamber disposed therein. The lid includes a counter balance a cantilever and a hinge. The cantilever is disposed between the lid and the counter balance. The cantilever extends out from the lid to dispose the counter balance out from the lid. A hinge is disposed between the lid and the body and proximal to the cantilever. The hinge is configured to provide a pivot for the lid. A weight of the counter balance is configured to offset at least a portion of a weight of the lid to ease pivoting of the lid into an open position.

Another embodiment of the present invention relates to a system. The system includes a heat generating device and a lid. The heat generating device has a body with a combustion chamber disposed therein. The lid is configured to cover the combustion chamber. The lid includes an air moving device, an air intake housing, and a hinge. The air moving device is configured to generate a flow of air. The air intake housing is disposed between the lid and the air moving device. The air intake housing extends out from the lid to cantilever the air moving device out from the lid. The hinge is disposed between the lid and the body and proximal to the air intake housing. The hinge is configured to provide a pivot for the lid. A weight of the air moving device counter balances at least a portion of a weight of the lid to ease pivoting of the lid into an open position.

Yet another embodiment of the present invention pertains to a method of inspecting a heat generating system. In the method, a heat generating device and a counter balanced lid are provided. The heat generating device has a body with a combustion chamber disposed therein. The counter balanced lid is configured to cover the combustion chamber. The counter balanced lid includes an air moving device, an air intake housing, and a hinge. The air moving device is configured to generate a flow of air. The air intake housing is disposed between the counter balanced lid and the air moving device. The air intake housing extends out from the counter balanced lid to cantilever the air moving device out from the counter balanced lid. The hinge is disposed between the counter balanced lid and the body and proximal to the air intake housing. The hinge is configured to provide a pivot for the counter balanced lid. The the counter balanced lid is pivoted to an open position to inspect the combustion chamber. A weight of the air moving device counter balances at least a portion of a weight of the counter balanced lid to ease pivoting of the counter balanced lid into the open position.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
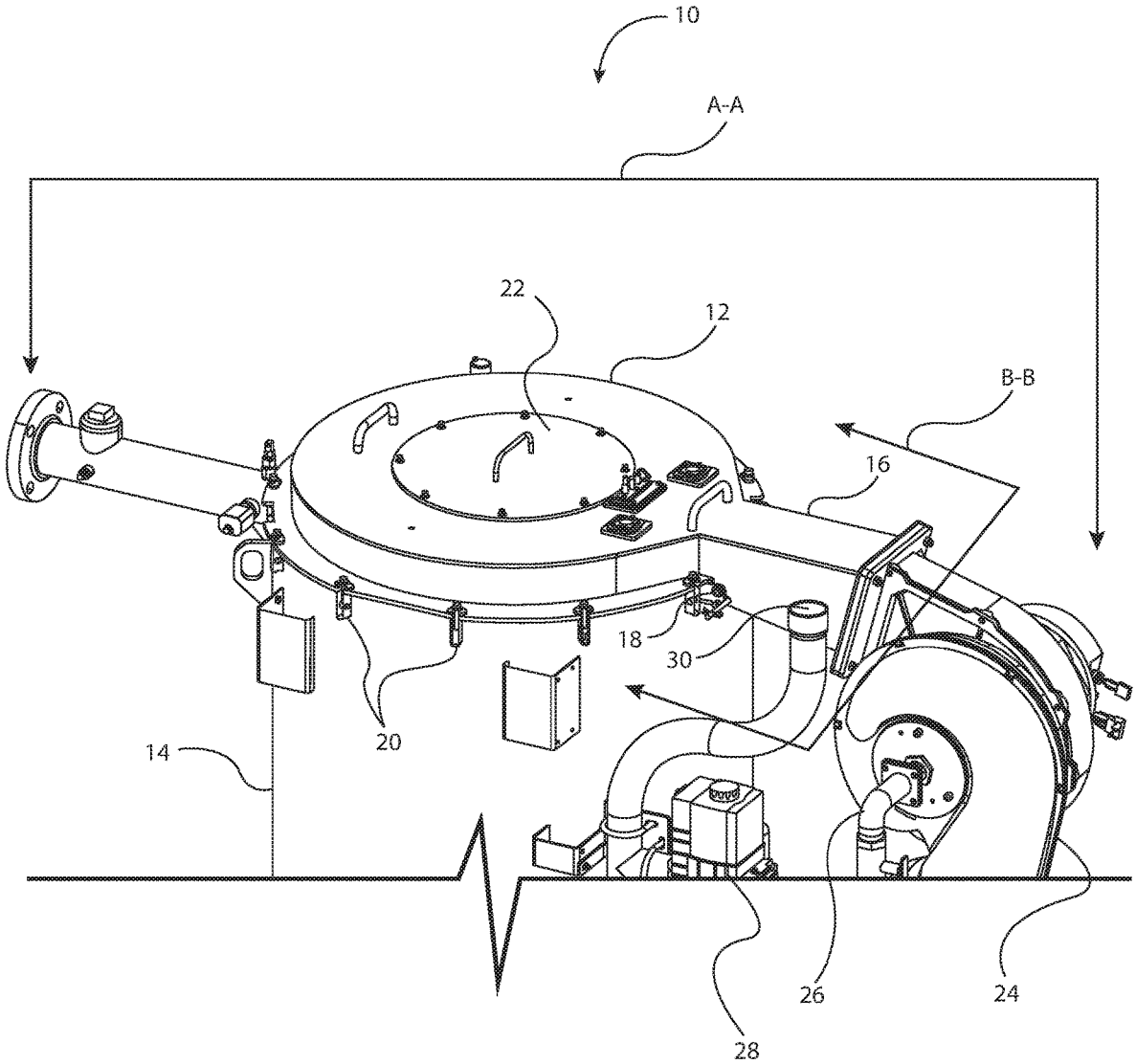
FIG. 1 is an orthogonal view of a boiler suitable for use with an embodiment of the present invention.

Various embodiments of the present invention provide for an improved lid for a suitable heat generating device. Examples of suitable heat generating devices include: boilers; process heaters; furnaces; or other such devices configured to generate heat. The heat generated may be transferred to any suitable transfer fluid. Suitable transfer fluids include: water; steam; air; and the like. The lid covers and provides access to a combustion chamber and may also be referred to as a cover plate, burner door, combustion chamber door, combustion chamber access, etc. It is a benefit of embodiments of the invention that the lid includes a counter balance and a hinge to facilitate open the lid for inspection and maintenance of the combustion chamber and other internal components. The counter balance may include any suitable weight such as a mass of metal or other material and/or may include a component of the heat generating device. For example, the counter balance may include one or more component such as a valve, a motor, a manifold, and/or an air moving device such a blower, an inducer, or the like. The heat generating device may burn any suitable fuel such as natural gas, propane, oil, or the like.

In these embodiments, the lid may include channels to convey cool air and/or fuel between the underside of the lid and the combustion chamber. These channel are configured to provide an air to air heat exchanger to cool the lid. For example, the flow of cool air/gas through the channels absorbs heat from the inside surface of the lid to cool the lid. Advantages of this lid cooling function include: Increased efficiency due to a decrease of heat loss through the lid; Improved longevity of components near lid due to reduced temperature of lid; improved work environment due to reduced temperature of lid; and the like. Preferred embodiments of the invention will now be further described with reference to the drawing figures, in which like reference numerals refer to like parts throughout.

Turning now to the drawings, FIG. 1 a boiler 10 is shown having a lid 12 and a body 14. As described herein, the boiler 10 is shown for illustrative purposes only and other embodiments are not limited to boilers, but rather, may include any suitable heat generating device such as a furnace, process heater, or the like. The lid 12 includes an air/gas intake housing 16, a hinge 18, fasteners 20, and an optional access cover 22. A blower 24 is affixed to the air/gas intake housing 16. While the particular example shown in FIG. 1 includes the blower 24, the invention is not limited to blowers, but rather, may include any suitable device for moving air such as an inducer, fan, or the like. A gas supply line 26 provides gas from a valve 28. A gas supply 30 supplies gas to the valve 28. While the example shown in FIG. 1 describes the use of 'gas' any suitable fuel may be included in other examples. Suitable fuels include natural gas, propane, oil, wood, or the like.

Figure 2:
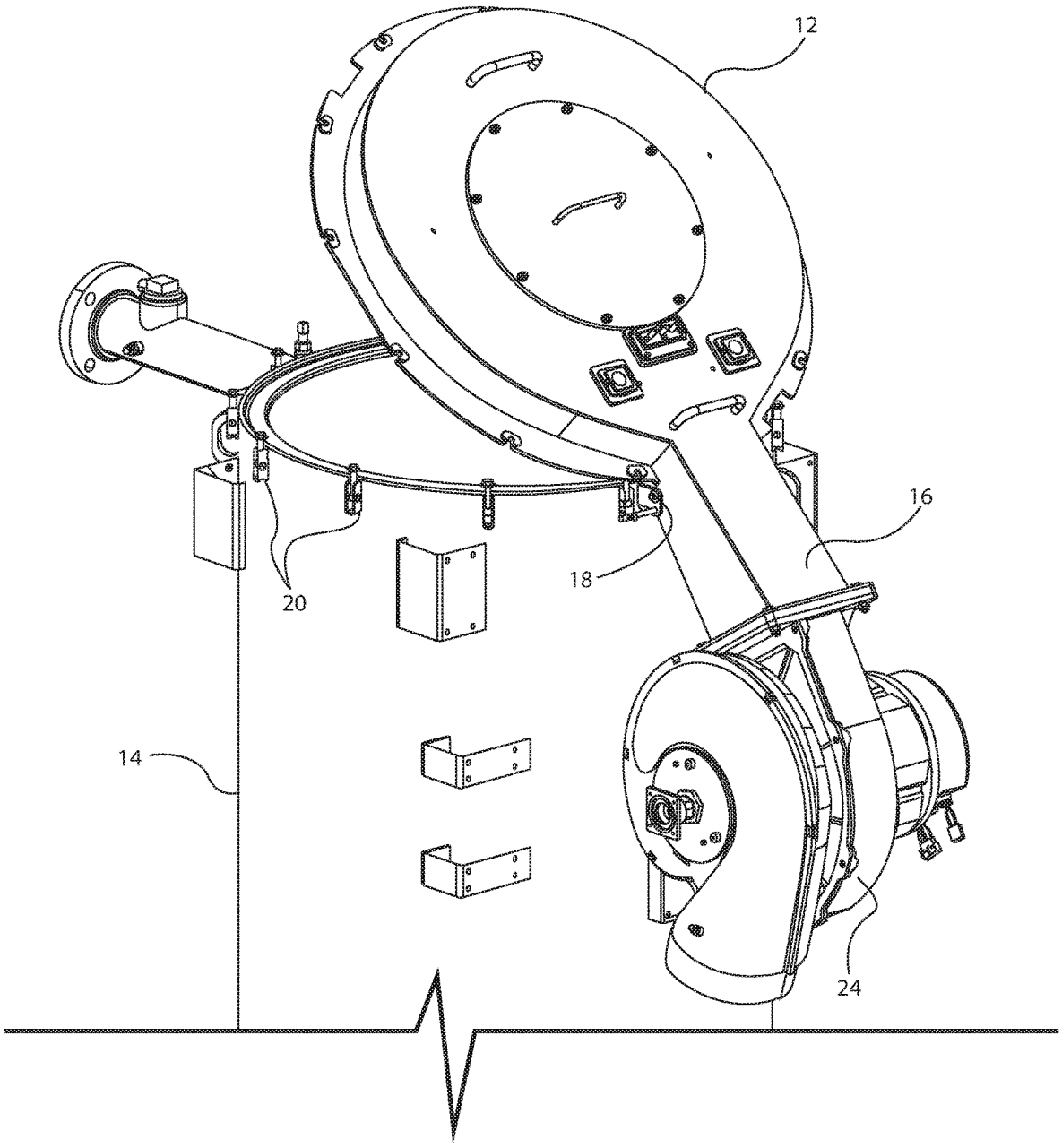
FIG. 2 is a partially disassembled orthogonal view of the boiler depicted in FIG. 1 with a blower to counter balance a lid and to facilitate opening the lid of the boiler.

FIG. 2 is a partially disassembled orthogonal view of the boiler 10 depicted in FIG. 1 with the lid 12 in an open position. It is an advantage of the counter balanced and hinged lid 12 that accessing the internal components of the boiler 10 is greatly facilitated. As shown in FIG. 2, the blower 24 counter balancing the lid 12 and pivoting on the hinge 18 greatly eases opening the lid 12 to gain access to internal components of the boiler 10. In a particular example, the lid 12 may weigh about 30 kilogram (kg) or more and the blower 24 may weigh about 25 kg. By cantilevering the blower 24 out from the lid 12 via the air/gas intake housing 16, the counter balanced lid 12 may pivot on the hinge 18 with the application of a relatively small downward push on the blower 24 of about 5 kg. In this manner, opening the lid 12 for inspection and maintenance may be greatly facilitated. In addition, by positioning the blower 24 away from the lid 12, the blower 24 may be kept cooler than if directly attached to the lid 12 or body 14 and air drawn in by the blower 24 may be relatively cooler than air closer to the boiler 10. The cooler air may, in turn, help cool the lid 12.

Figure 3:
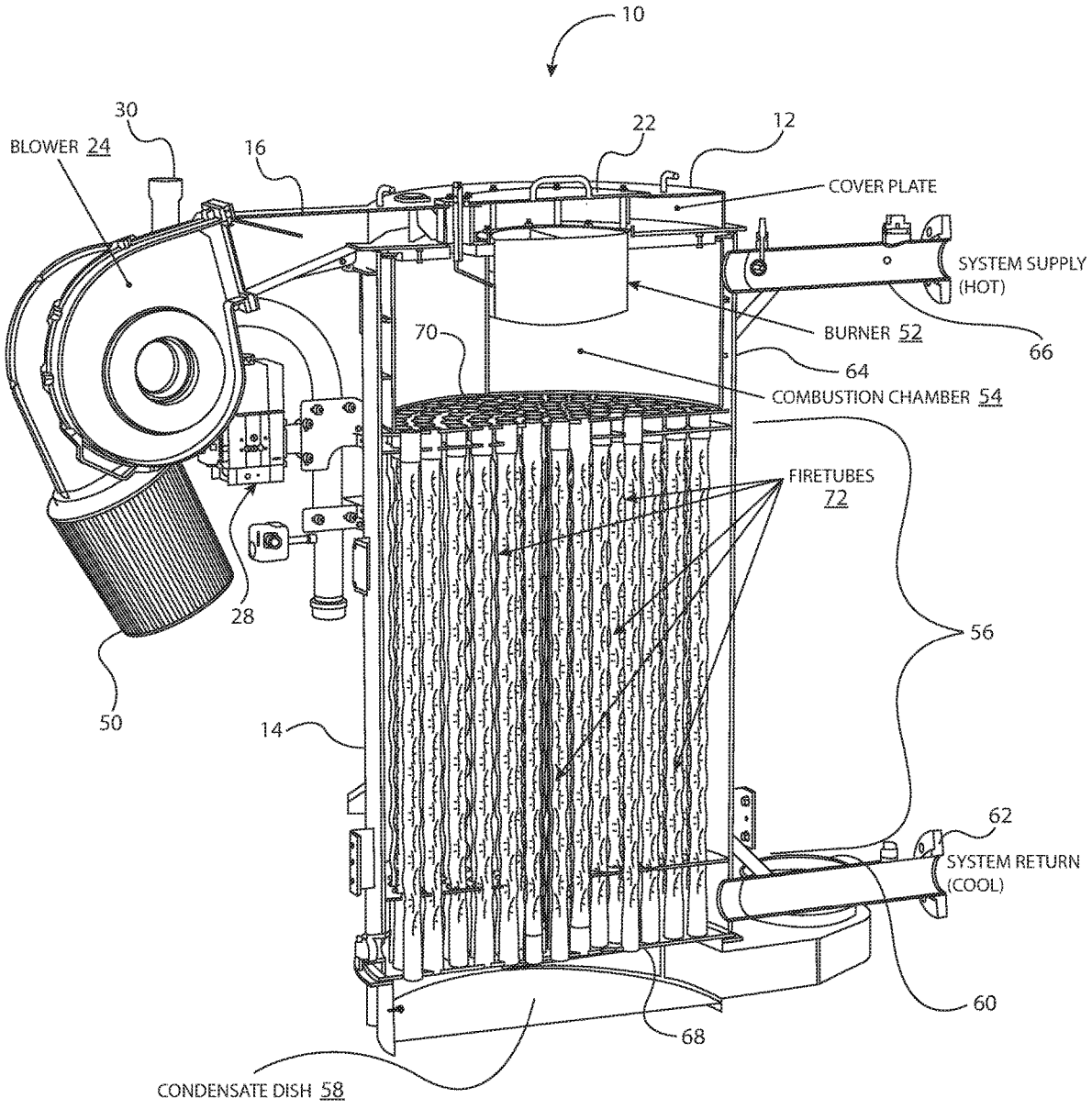
FIG. 3 is a partial cross sectional A-A and orthogonal view of the boiler in FIG. 1.
Figure 4:
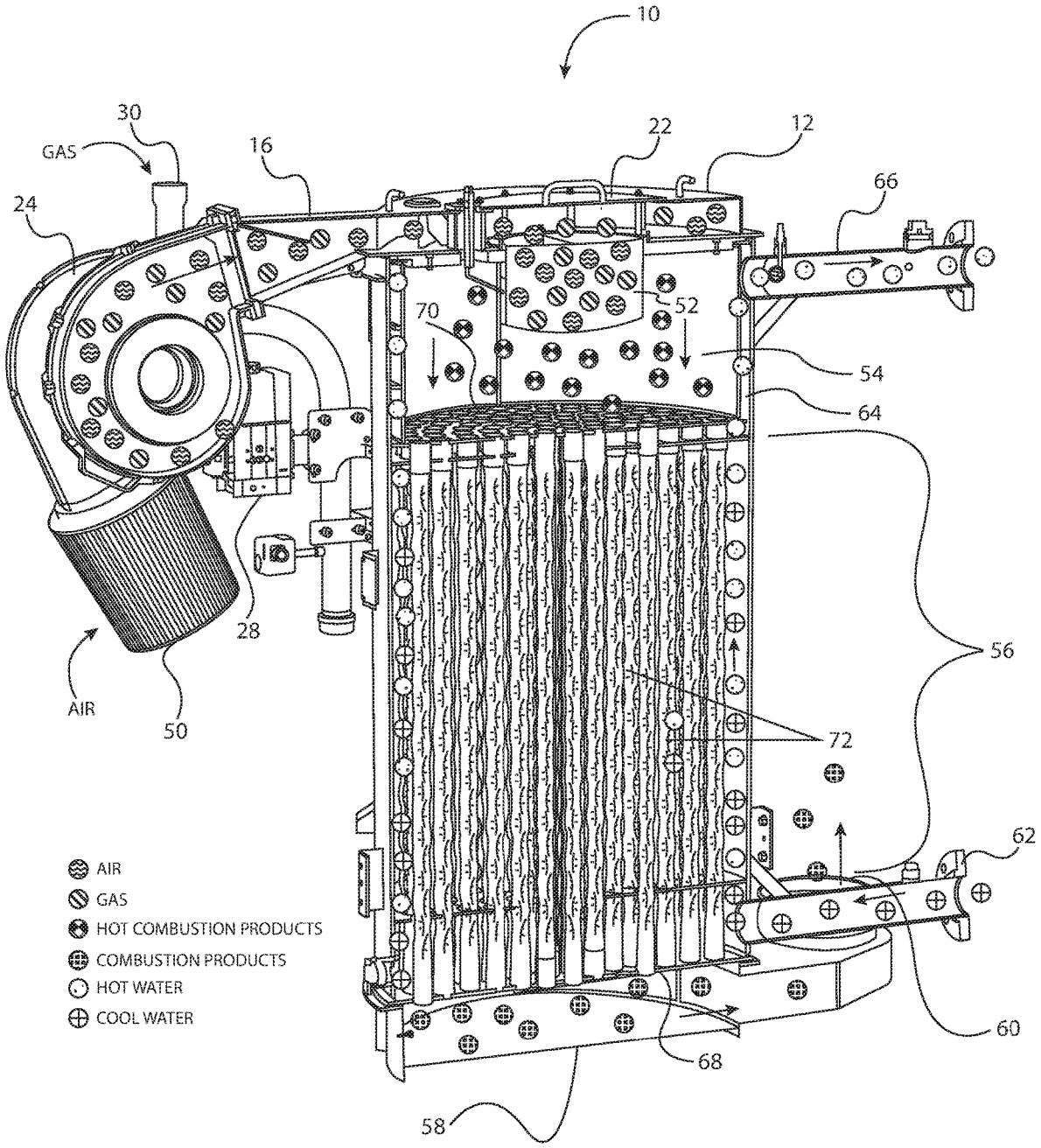
FIG. 4 is a partial cross sectional A-A and orthogonal view of the boiler depicted in FIG. 1 showing fluid flow and heat transfer.

FIGS. 3 and 4 are partial cross sectional A-A and orthogonal views of the boiler 10 in FIG. 1. As shown in FIGS. 3 and 4, the boiler 10 includes an air intake 50, a burner 52, a combustion chamber 54, a heat exchanger 56, a condensate dish 58, an exhaust 60, a cool water inlet or system return 62, a combustion chamber jacket passage 64, and a hot water outlet or system supply 66. The heat exchanger 56 includes a bottom plate 68, a top plate 70, and a plurality of heat exchange tubes 72.

Air is drawn in by the blower 24 via the air intake 50 and mixed with a combustible gas such as natural gas, propane, or the like. The air/gas mixture is conveyed through a plurality of channels 84A, 84B, 86A, and 86B (Shown in FIGS. 5 and 6) disposed in an underside of the lid 12. As described herein with reference to FIGS. 5 and 6, air/gas flow through the plurality of channels 84A, 84B, 86A, and 86B is configured to provide an air to air heat exchange that exchanges heat with the lid 12. In a particular example, the temperature of even a well-insulated conventional lid may exceed 150° C., while the temperature of the lid 12 may be about 65° C. As the air/gas mixture passes through the burner 52, which functions as a flame arrestor, the air/gas mixture is ignited in the combustion chamber 54. Depending on the fuel and other factors, the temperature in the combustion chamber 54 may be about 1100° C. Hot combustion products are driven down through the plurality of heat exchange tubes 72 while water passes upward in a counterflow manner past the plurality of heat exchange tubes 72. The condensate dish 58 collects condensate and the now cooled combustion products exit the boiler 10 via the exhaust 60. The system return 62 supplies water to the heat exchanger 56. After passing through the heat exchanger 56, the heated water passes through the combustion chamber jacket passage 64 where it is further heated and then exits the boiler 10 via the system supply 66.

Figure 5:
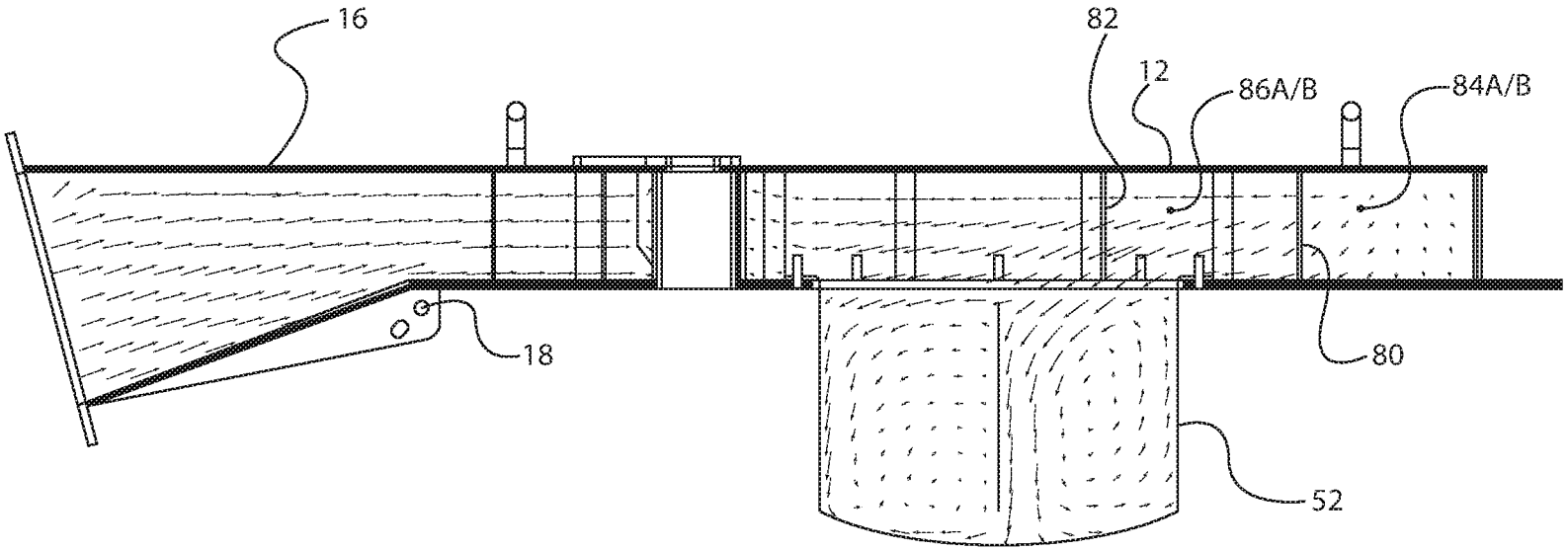
FIG. 5 is a cross sectional view A-A through the lid of the boiler depicted in FIG. 1 showing air/gas flow.
Figure 6:
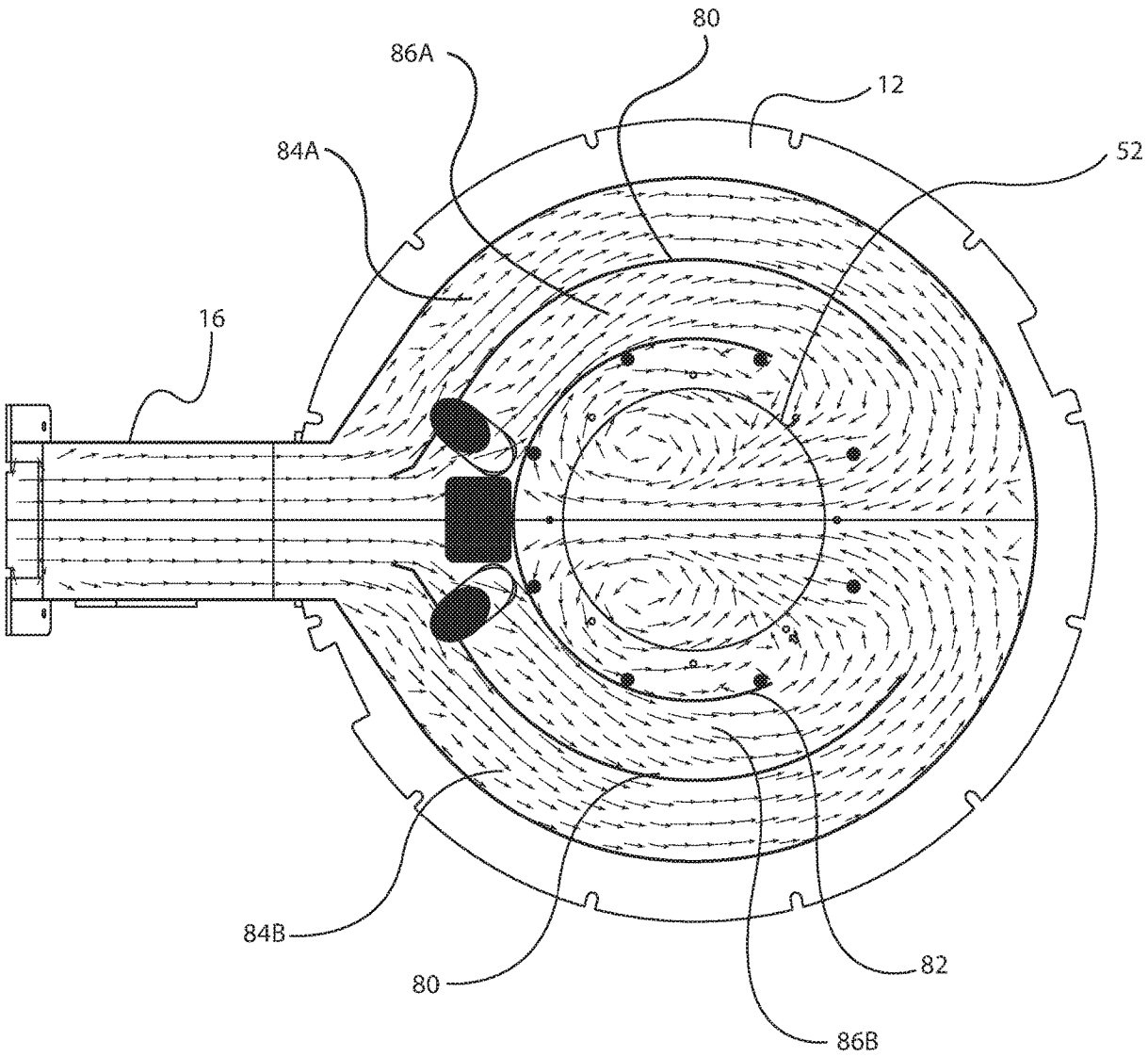
FIG. 6 is a cross sectional view B-B through the lid of the boiler depicted in FIG. 1 showing air/gas flow.

FIG. 5 is a cross sectional view A-A through the lid 12 showing air/gas being conveyed through the plurality of channels 84A, 84B, 86A, and 86B (Shown also in FIG. 6) disposed in an underside of the lid 12. The air/gas flow through the plurality of channels 84A, 84B, 86A, and 86B is configured to provide an air to air heat exchange that exchanges heat with the lid 12. The plurality of channels 84A, 84B, 86A, and 86B are configured to direct the flow of air/gas evenly across the inside surface of the lid 12 to facilitate a uniform cooling across the lid 12. Of note, while 4 channels 84A, 84B, 86A, and 86B are shown in FIGS. 5 and 6, other examples may include any suitable number of channels such as, for example, 2, 3, 5, 6, or more. In this regard, the plurality of channels 84A, 84B, 86A, and 86B are defined by a plurality of baffles 80 and 90 (Shown also in FIG. 6). As shown from the side in FIG. 5, the baffles extend from the inner surface of the lid 12 to form a surface defining the channels 84A, 84B, 86A, and 86B.

FIG. 6 is a cross sectional view B-B through the lid 12 showing air/gas flowing across an inside surface of the lid 12 and entering the burner 52. The plurality of baffles 80 and 90 include a plurality of outer baffles 80 and an inner baffle 82 that are configured to direct the flow of air/gas through the channels 84A, 84B, 86A, and 86B uniformly around the underside of the lid 12. As shown in FIG. 6, the channels 84A and 84B define a first channel and the channels 86A and 86B define a second channel. Again, the air/gas flow through the plurality of channels 84A, 84B, 86A, and 86B is configured to provide an air to air heat exchange that exchanges heat with the lid 12. In this manner, the semi-circular baffles 80 and 82 create flow paths configured to direct the flow of air/gas evenly across the inside surface of the lid 12 to facilitate a uniform cooling across the lid 12.

Figure 7:
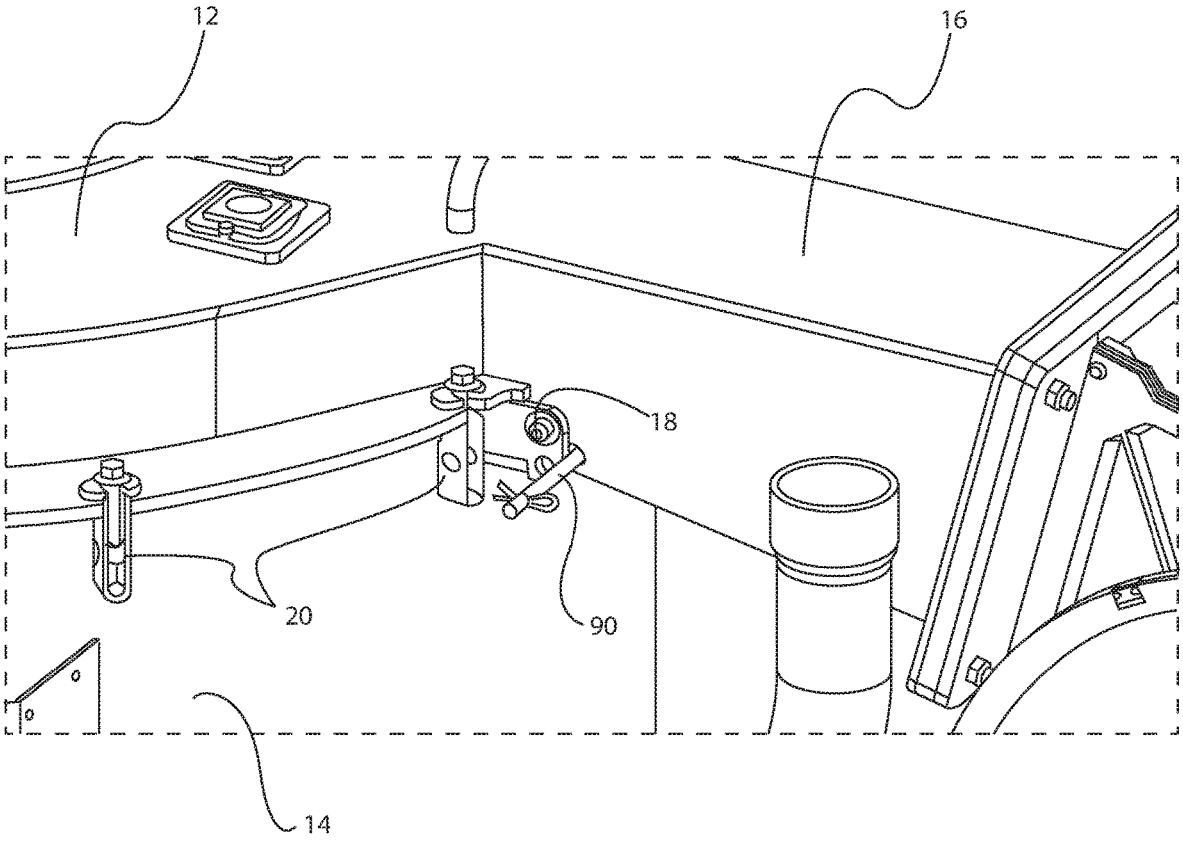
FIG. 7 is a more detailed orthogonal view of the boiler depicted in FIG. 1 with the lid in the closed position and showing a hinge having a locking pin.
Figure 8:
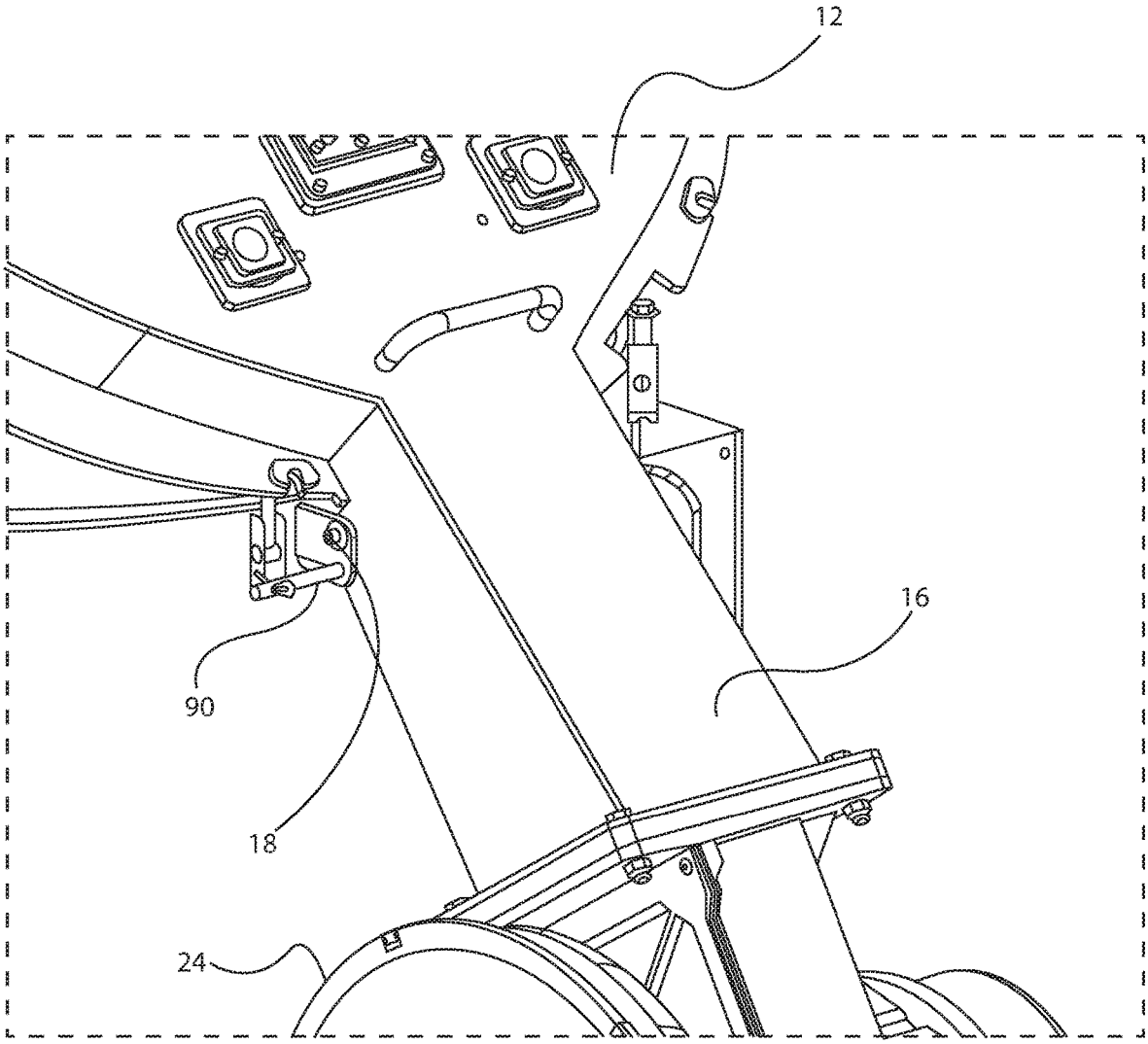
FIG. 8 is a partially disassembled more detailed orthogonal view of the boiler depicted in FIG. 1 with the blower to counter balance the lid and showing the locking pin to retain the lid in the open position.

FIG. 7 is a more detailed orthogonal view of the boiler 10 with the lid 12 in the closed position and showing a locking pin 90. As shown in FIG. 7, the lid 12 is secured to the body via the fasteners 20. In FIG. 8, the locking pin 90 has been removed, the lid 12 has been rotated on the hinge 18 into the open position, and the locking pin 90 has been re-inserted to lock the lid in the open position. Again, the opening of the lid 12 is greatly eased by the counter balance configuration of the blower 24 cantilevered out from the lid 12 via the air/gas intake housing.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A lid for a heat generating device, the heat generating device having a body with a combustion chamber disposed therein, the lid comprising:

a counter balance, wherein the counter balance is an air moving device configured to generate a flow of air; and a cantilever disposed between the lid and the counter balance, the cantilever extending out from the lid to dispose the counter balance out from the lid;

a hinge disposed between the lid and the body and proximal to the cantilever, the hinge configured to provide a pivot for the lid, wherein a weight of the counter balance is configured to offset at least a portion of a weight of the lid to ease pivoting of the lid into an open position;

a first semi-circular baffle disposed between an underside of the lid and the combustion chamber, the first semi-circular baffle defining a first channel; and a second semi-circular baffle disposed between the underside of the lid and the combustion chamber, the second semi-circular baffle defining a second channel, wherein the first channel and the second channel direct the flow of air laterally across and uniformly around the underside of the lid between the underside of the lid and the combustion chamber to provide an air to air heat exchange to extract heat from the lid.

2. The lid according to claim 1, wherein the counter balance is a component of the heat generating device.

3. The lid according to claim 2, wherein the cantilever is an air intake housing disposed between the lid and the air moving device to provide a conduit for the flow of air from the air moving device to the lid.

4. The lid according to claim 3, wherein the air moving device is a blower.

5. The lid according to claim 1, further comprising a locking pin disposed adjacent to the hinge and configured to lock the lid in the open position.

6. The lid according to claim 1, wherein the heat generating device is a boiler.

7. A system comprising:

a heat generating device, the heat generating device having a body with a combustion chamber disposed therein; and a lid configured to cover the combustion chamber, the lid comprising:

an air moving device configured to generate a flow of air; and an air intake housing disposed between the lid and the air moving device, the air intake housing extending out from the lid to cantilever the air moving device out from the lid;

a hinge disposed between the lid and the body and proximal to the air intake housing, the hinge configured to provide a pivot for the lid, wherein a weight of the air moving device counter balances at least a portion of a weight of the lid to ease pivoting of the lid into an open position;

a first semi-circular baffle disposed between an underside of the lid and the combustion chamber, the first semi-circular baffle defining a first channel; and a second semi-circular baffle disposed between the underside of the lid and the combustion chamber, the second semi-circular baffle defining a second channel, wherein the first channel and the second channel direct the flow of air laterally across and uniformly around the underside of the lid between the underside of the lid and the combustion chamber to provide an air to air heat exchange to extract heat from the lid.

8. The system according to claim 7, further comprising a locking pin disposed adjacent to the hinge and configured to lock the lid in the open position.

9. The system according to claim 7, wherein the heat generating device is a boiler.

10. The system according to claim 7, wherein the air moving device is a blower.

11. A method of inspecting a heat generating system, the method comprising the steps of:

providing a heat generating device, the heat generating device having a body with a combustion chamber disposed therein;

providing a counter balanced lid configured to cover the combustion chamber, the counter balanced lid comprising:

an air moving device configured to generate a flow of air; and an air intake housing disposed between the counter balanced lid and the air moving device, the air intake housing extending out from the counter balanced lid to cantilever the air moving device out from the counter balanced lid;

a hinge disposed between the counter balanced lid and the body and proximal to the air intake housing, the hinge configured to provide a pivot for the counter balanced lid;

a first semi-circular baffle disposed between an underside of the lid and the combustion chamber, the first semi-circular baffle defining a first channel; and a second semi-circular baffle disposed between the underside of the lid and the combustion chamber, the second semi-circular baffle defining a second channel, wherein the first channel and the second channel direct the flow of air laterally across and uniformly around the underside of the lid between the underside of the lid and the combustion chamber to provide an air to air heat exchange to extract heat from the lid; and pivoting the counter balanced lid to an open position to inspect the combustion chamber, wherein a weight of the air moving device counter balances at least a portion of a weight of the counter balanced lid to ease pivoting of the counter balanced lid into the open position.

12. The method according to claim 11, further comprising the step of disposing a locking pin adjacent to the hinge to lock the counter balanced lid in the open position.

13. The method according to claim 11, wherein the heat generating device is a boiler.

14. The method according to claim 11, wherein the air moving device is a blower.

* * * * *